US011264708B2

(12) United States Patent
Kristl et al.

(10) Patent No.: US 11,264,708 B2
(45) Date of Patent: Mar. 1, 2022

(54) COMPONENT CARRIER WITH INTEGRATED ANTENNA STRUCTURE

(71) Applicant: AT & S Austria Technologie & Systemtechnik Aktiengesellschaft, Leoben (AT)

(72) Inventors: Thomas Kristl, Trofaiach (AT); Martin Reiter, St. Peter Freienstein (AT); Johannes Stahr, St. Lorenzen im Mürztal (AT); Markus Leitgeb, Trofaiach (AT); Gernot Grober, Graz (AT); Erich Schlaffer, St. Lorenzen (AT)

(73) Assignee: AT&S Austria Technologie & Systemtechnik Aktiengesellschaft, Leoben (AT)

( * ) Notice: Subject to any disclaimer, the term of this patent is extended or adjusted under 35 U.S.C. 154(b) by 493 days.

(21) Appl. No.: 15/546,658

(22) PCT Filed: Jan. 26, 2016

(86) PCT No.: PCT/EP2016/051540
§ 371 (c)(1),
(2) Date: Jul. 26, 2017

(87) PCT Pub. No.: WO2016/120254
PCT Pub. Date: Aug. 4, 2016

(65) Prior Publication Data

US 2018/0277943 A1 Sep. 27, 2018

(30) Foreign Application Priority Data

Jan. 27, 2015 (DE) ..... 102015101119.0

(51) Int. Cl.
*H01Q 7/00* (2006.01)
*H01Q 1/38* (2006.01)
(Continued)

(52) U.S. Cl.
CPC ..... *H01Q 1/38* (2013.01); *H01Q 1/2225* (2013.01); *H01Q 7/00* (2013.01); *H01Q 9/26* (2013.01); *H01Q 13/0208* (2013.01)

(58) Field of Classification Search
CPC ..... H01Q 1/38; H01Q 1/2225; H01Q 9/26; H01Q 7/00; H01Q 13/0208
See application file for complete search history.

(56) References Cited

U.S. PATENT DOCUMENTS 5,436,441 A * 7/1995 Inoue ..... G06K 19/07779 235/487
5,450,090 A * 9/1995 Gels ..... H01Q 9/0414 343/700 MS
(Continued)

FOREIGN PATENT DOCUMENTS

CN 1617384 A 5/2005
CN 101909408 A 8/2010
(Continued)

OTHER PUBLICATIONS

Tajima et al., "300-GHz LTCC Horn Antennas Based on Antenna-in-package Technology", Proceedings of the 43rd European Microwave Conference, Oct. 7-10, 2013, Nuremberg, Germany (Year: 2013).*
(Continued)

*Primary Examiner* — Andrea Lindgren Baltzell
*Assistant Examiner* — Bamidele A Jegede
(74) *Attorney, Agent, or Firm* — Robert A. Blaha; Smith Tempel Blaha LLC

(57) ABSTRACT

An electronic assembly and a method for fabricating the same are disclosed. The assembly includes a component carrier, a wireless communication component and an antenna structure. The component carrier has at least one dielectric layer and a metallic layer. The wireless communication component is attached to the component carrier.
(Continued)

The antenna structure is formed from a metallic material and is electrically connected with the wireless communication component. An opening formed in the component carrier extends from an upper surface into the interior of the component carrier. The antenna structure is formed at least partially at a wall of the opening.

12 Claims, 6 Drawing Sheets

(51) Int. Cl.
*H01Q 9/26* (2006.01)
*H01Q 13/02* (2006.01)
*H01Q 1/22* (2006.01)

(56) References Cited

U.S. PATENT DOCUMENTS 5,990,768 A * 11/1999 Takahashi ..... H01P 3/084 257/664
5,995,006 A 11/1999 Walsh
6,064,350 A * 5/2000 Uchimura ..... H01Q 21/0093 343/786
6,282,358 B1 * 8/2001 Hornbeck ..... G02B 6/125 385/131
6,559,798 B1 5/2003 Marumoto et al.
6,593,900 B1 7/2003 Craven et al.
6,646,609 B2 * 11/2003 Yuasa ..... H01Q 1/243 343/700 MS
6,779,730 B2 * 8/2004 Fletout ..... H05K 1/111 235/492
6,837,438 B1 * 1/2005 Takasugi ..... G06K 19/0723 235/492
7,271,686 B2 9/2007 Yoshikawa et al.
7,480,435 B2 1/2009 Brist et al.
7,864,123 B2 1/2011 Hill et al.
8,217,842 B2 7/2012 Pedersen et al.
8,629,423 B1 * 1/2014 Kislov ..... H01Q 13/10 257/13
9,196,951 B2 11/2015 Baks et al.
2002/0135523 A1 * 9/2002 Romero ..... H01Q 1/24 343/741
2003/0035613 A1 * 2/2003 Huber ..... G02B 6/125 385/16
2003/0059151 A1 * 3/2003 Brist ..... H05K 1/0237 385/14
2004/0113840 A1 * 6/2004 Gottwald ..... H01Q 9/045 343/700 MS
2005/0007296 A1 * 1/2005 Endo ..... G06K 19/07749 343/895
2005/0088260 A1 * 4/2005 Ajioka ..... H01L 23/66 333/247
2005/0184914 A1 * 8/2005 Ollikainen ..... H01Q 1/243 343/702
2006/0001138 A1 * 1/2006 Sakama ..... H01Q 1/2225 257/678
2006/0055517 A1 * 3/2006 Ghabra ..... H01Q 1/38 340/426.11
2006/0124753 A1 * 6/2006 Scholz ..... G06K 19/07749 235/492
2006/0238420 A1 10/2006 Jansen
2007/0095925 A1 * 5/2007 Zhu ..... G06K 19/07749 235/492
2007/0252768 A1 * 11/2007 Mohamadi ..... H01Q 3/34 343/776
2008/0042917 A1 * 2/2008 Seki ..... H01Q 1/38 343/767
2008/0123768 A1 5/2008 Harel et al.
2009/0021446 A1 * 1/2009 Kataya ..... H01Q 1/2225 343/860
2009/0224061 A1 * 9/2009 Kato ..... G06K 19/07749 235/492
2009/0256752 A1 * 10/2009 Akkermans ..... H01Q 21/061 343/700 MS
2010/0033395 A1 2/2010 Ding et al.
2010/0033709 A1 2/2010 Lampin et al.
2010/0161002 A1 6/2010 Aghassian et al.
2010/0197261 A1 8/2010 Zibrik et al.
2010/0231481 A1 * 9/2010 Chiang ..... H01Q 9/30 343/898
2011/0024510 A1 * 2/2011 Kato ..... G06K 19/07779 235/492
2011/0057853 A1 * 3/2011 Kim ..... H01Q 1/48 343/843
2011/0074584 A1 * 3/2011 Kataya ..... H01Q 1/48 340/572.8
2011/0133991 A1 * 6/2011 Lee ..... H01Q 13/00 343/700 MS
2011/0140799 A1 * 6/2011 Biran ..... H01P 3/121 333/26
2011/0248890 A1 * 10/2011 Lee ..... H01Q 1/38 343/700 MS
2011/0260919 A1 10/2011 Montag et al.
2012/0056796 A1 3/2012 Kato et al.
2012/0256796 A1 * 10/2012 Leiba ..... H01Q 1/2283 343/702
2012/0306700 A1 * 12/2012 Ridgeway ..... H01Q 1/2291 343/700 MS
2013/0050032 A1 * 2/2013 Shiu ..... H01Q 1/44 343/702
2013/0194146 A1 * 8/2013 Lee ..... H01Q 1/243 343/767
2013/0249663 A1 * 9/2013 Cho ..... H01F 38/14 336/200
2013/0271322 A1 10/2013 Harel et al.
2014/0145883 A1 * 5/2014 Baks ..... H01Q 1/2283 343/700 MS
2014/0152509 A1 * 6/2014 Liu ..... H01Q 9/0407 343/700 MS
2014/0285393 A1 * 9/2014 Biglarbegian ..... H01P 11/001 343/850
2015/0035714 A1 2/2015 Zhou
2015/0070231 A1 * 3/2015 Park ..... H01Q 21/08 343/777
2015/0194736 A1 7/2015 Diukman et al.
2015/0357708 A1 12/2015 Au
2016/0013556 A1 * 1/2016 Kato ..... H01Q 9/27 343/702
2016/0261036 A1 * 9/2016 Sato ..... G01S 7/4026
2016/0351996 A1 * 12/2016 Ou ..... H01Q 21/064

FOREIGN PATENT DOCUMENTS

CN 101849329 A 9/2010
CN 101849369 A 9/2010
CN 102247050 A 11/2011
CN 104009279 A 8/2014
CN 104064852 A 9/2014
CN 105390854 A 3/2016
DE 10 134 958 A1 2/2003
DE 10 2004 054 622 A1 5/2006
EP 1 613 134 A2 1/2006
EP 1 713 022 A1 10/2006
EP 2 141 970 A1 1/2010
JP H10303640 A 11/1998
JP 2002344146 A 11/2002
JP 2007209017 A 3/2007
JP 3926677 B2 6/2007
JP 2007202017 A 8/2007
JP 2013 247 294 A 9/2013
KR 20100056004 A 5/2010
KR 101464261 B1 11/2014
KR 20160008457 A 1/2016
WO WO 0023994 A1 4/2000
WO WO 2012036844 A1 3/2012

(56) References Cited

FOREIGN PATENT DOCUMENTS

| | | |
|---|---|---|
| WO | WO 2014125927 A1 | 8/2014 |
| WO | WO 2015108745 A1 | 7/2015 |

OTHER PUBLICATIONS

Jastram Nathan et al.; "PCB-Based Prototyping of 3-D Micromachined RF Subsystems", IEEE Transactions on Antennas and Propagation, IEEE Service Center, Piscataway, N.J., US, vol. 62, No. 1, Jan. 1, 2014, 420-429 pp., XP011536450, ISSN: 0018-926X [ Retrieved on Dec. 31, 2013].

Jastram Nathan et al.; "PCB-Based Prototyping of 3-D Machined RF Subsystems", IEEE Transactions on Antennas and Propagation, IEEE Service Center, Piscataway, N.J., US, vol. 62, No. 1, Jan. 1, 2014, 420-429 pp., XP011536450, ISSN: 0018-926X [ Retrieved on Dec. 31, 2013].

European Patent Office, Communication Pursuant to Article 94(3) EPC, Application 16701513.0, dated Apr. 5, 2019, 11 pgs., HV Rijswijk, Netherlands.

Marceau, C. et al; Femtosecond Laser Pulse Compression Suing Angle of Incidence Optimization of Chirped Mirrors Laser Physics Letters vol. 11, No. 6, Jun. 1, 2014, 065302.

Office Action in Application No. 201780026390.1; China Intellectual Property Administration; pp. 1-8; dated Mar. 30, 2020; Shanghai, China.

First Office Action in CN202010193199.X; China National Intellectual Property Administration, pp. 1-8; dated Dec. 14, 2021, No. 6, Xitucheng Lu, Jimenqiao Haidan District, Beijing City, 1000088, China.

English Translation of Cover Page of First Office Action in CN202010193199.X; China National Intellectual Property Administration, pp. 1-3; dated Dec. 14, 2021, No. 6, Xitucheng Lu, Jimenqiao Haidian District, Beijing City, 1000088, China.

* cited by examiner

COMPONENT CARRIER WITH INTEGRATED ANTENNA STRUCTURE

CROSS-REFERENCE TO RELATED APPLICATIONS

This application is a U.S. national phase application of international patent application PCT/EP2016/051540 filed on Jan. 26, 2016, which claims the benefit of the filing date of German Patent Application No. 10 2015 101 119.0, filed on Jan. 27, 2015, the disclosures of which are hereby incorporated herein by reference in their entirety.

TECHNICAL FIELD

Embodiments of the present invention generally relate to the technical field of component carriers respectively printed circuit boards, at which electronic components can be mounted in order to build up an electronic assembly. Specifically, embodiments of the present invention relate to an electronic assembly comprising such a component carrier, a wireless communication component being attached to the component carrier and an antenna structure being formed at the component carrier and being connected to the wireless communication component.

TECHNOLOGICAL BACKGROUND

In modern fabrication of electronic devices it becomes increasingly important to realize a traceability of fabricated electronic assemblies such that they can be identified in a unique manner even after an installation in electronic apparatuses. This is in particular important for safety relevant electronic assemblies such as a control unit for an airbag. A full traceability makes it possible that in case of a failure of an electronic assembly, similar electronic assemblies, which have been built up at the same time with the same or with at least similar electronic components, can be removed from the market.

In order to realize a traceability of electronic assemblies it is known to provide a printed circuit board (PCB), on which an electronic circuit comprising at least one electronic component is mounted, with a unique marking. Such a marking can be a pure optical marking such as for instance a 1D barcode or a 2D matrix code. However, a unique marking is preferably realized by means of an appropriately programmed Radio Frequency Identification (RFID) chip which is inserted in or attached to a PCB already during the fabrication of the PCB.

For communicating with an RFID read and/or write device (RFID reader and/or writer) an RFID chip must be connected with an RFID antenna. An RFID antenna can be realized by means of an antenna structure which is formed at the respective PCB by patterning a metallic layer.

EP 2 141 970 A1 discloses a PCB with an RFID chip. The PCB comprises a cavity in which the RFID chip is inserted in such a manner that the RFID chip does not protrude beyond the outer dimensions of the PCB.

EP 1 613 134 A2 discloses a PCB with a recesses formed at a lateral edge of the PCB. Within the recess there is located an RFID chip. At the edge of the PCB there is further formed a metallic antenna structure for the RFID chip.

There may be a need for providing a wireless communication component being integrated in or attached to a PCB with an antenna structure, which is mechanically robust and which has a good electromagnetic efficiency in order to allow the wireless communication component to communicate with a wireless communication reader and/or wireless communication writer in a reliable manner.

SUMMARY

This need may be met by the subject matter according to the independent claims. Advantageous embodiments of the present invention are described by the dependent claims.

According to a first aspect of the invention there is provided an electronic assembly comprising (a) a component carrier, which comprises at least one dielectric layer and a metallic layer, which is attached at the dielectric layer; (b) a wireless communication component, which is attached to the component carrier; and (c) an antenna structure, which is formed from a metallic material and which is electrically connected with the wireless communication component. An opening is formed within the component carrier, which opening extends from an upper surface of the component carrier into the interior of the component carrier. Further, the antenna structure is formed at least partially at a wall of the opening.

The described electronic assembly is based on the idea, that a metallic antenna structure can be formed not only at an upper, lower and/or lateral side of a component carrier but also at least partially within (the 3D dimensions of) the component carrier. In such a design the antenna structure is automatically protected from external mechanical impacts. As a consequence, a high robustness of the whole electronic assembly can be achieved and a reliable wireless data communication can be guaranteed.

The conductive material may be any material which provides for an electric conductivity which is sufficient such that the described antenna structure is usable for a wireless communication. Apart from a metallic material also other conductive materials can be used such as e.g. conductive carbon, a semiconductor material (e.g. optically transparent Indium gallium zinc oxide) or adhesive plaster with metallic stripes (e.g. silver stripes).

In case the conductive material of the antenna structure is a metallic material this metallic material may be preferably the same material as the material being used for the (at least one) metallic layer. This may provide the advantage that the antenna structure can be formed in an easy manner already during a fabrication of the component carrier. Preferably, the metallic material comprises copper or is copper.

In this document the term "wireless communication component" may denote any electronic device which is capable of controlling, performing, and/or participating in a contactless communication, wherein data are transferred in a wireless manner. The wireless communication component may be a component within a housing. Alternatively, the wireless communication component may be a bare die or a chip. Further, the wireless communication component may comprise appropriate electric circuits such as a transmitting circuit and/or a receiving circuit.

In this document the term "attached to the component carrier" may particularly mean that the wireless communication component is mounted to a surface of the component carrier. However, it may also be possible that the wireless communication component is integrated within the component carrier.

The wireless communication may be e.g. a Near Field Communication (NFC) and/or a RFID communication. In the latter case the "wireless communication component" may be called a RFID chip.

The wireless communication component may be connected directly, e.g. via only a conductor path, or indirectly, e.g. via one or more electronic components, with the antenna structure. Possible electronic components are passive electronic components such as in particular inductors and capacitors.

In this document the term "component carrier" may denote any substrate onto which electronic components and in particular Surface Mount Device (SMD) components can be mounted. The described component carrier may be, depending on the specific application, a rigid or alternatively a flexible structure. Further, the component carrier may have only one dielectric layer or alternatively at least two dielectric layers, wherein at least one of the two dielectric layers is sandwiched between two metallic layers. In the latter case the component carrier is a so called multilayer component carrier. Very often and also in this document a component carrier is denominated as a Printed Circuit Board (PCB).

In this document the term "opening" may denote any type of recess or cavity formed within the component carrier. The opening might also be a metallized via formed within the component carrier, which metallized via connects different antenna structure portions. In this case also the metallized via represents a portion of the antenna structure.

It is pointed out that it is not necessary that the opening is a free or unfilled (e.g. filled with air) opening. It is only necessary that during the manufacture of the described electronic assembly the opening is free or unfilled at least at a certain processing stage. In the final state of the electronic assembly the opening may be filled e.g. with a protective material such as a protective paint.

In the context of this document the upper surface and a lower surface of the component carrier may be surfaces which are located within a plane being parallel to a layer structure of the component carrier. In this respect the upper surface and a lower surface may be planar surfaces.

The described antenna structure may comprise two different portions, wherein a first portion is connected to a first terminal of the wireless communication component and the second portion is connected to a second terminal of the wireless communication component. According to the above presented specification of the electronic assembly the antenna structure may be formed completely at the wall of the opening or only partially at the wall of the opening. In the latter case the antenna structure may be designed in such a manner that only one of the two portions is located within the opening respectively at the wall of the opening. The other portion may be located anywhere else at or within the component carrier. In particular, an appropriately structured metallic layer may be used as the other portion of the antenna structure.

According to an embodiment of the invention an upper edge of the opening being located at the upper surface of the component carrier describes a closed line. This may mean that the opening is not a recess at an lateral edge or at a lateral region of the component carrier. The described opening is rather a hole, a hollow space, a chamber, and/or a cavity which is formed within the component carrier and which within any plane being parallel to the upper surface or a lower surface of the component carrier is surrounded by the component carrier.

According to a further embodiment of the invention the antenna structure is formed at least partially at a side wall of the opening. This may provide the advantage that a large area, which defines the opening, can be used for forming the antenna structure. This holds in particular if the opening has a comparatively small dimension along any direction being parallel to the (upper) surface of the component carrier. When using the side wall of the opening for forming the antenna structure, the antenna structure can, depending on the specific application, realized with an appropriate structural design.

According to a further embodiment of the invention the opening is a passage opening which extends from the upper surface to an opposing lower surface of the component carrier. This may mean that the opening of the full passage completely extends through the component carrier from the upper surface until the lower surface.

A passage opening may provide the advantage that it can be easily formed within the component carrier. This can be realized for instance by means of a known drilling or milling procedure. Alternatively, the passage opening can also be formed during a layer wise formation of the component carrier, wherein the involved layers comprise appropriately formed and located cut outs.

In particular in case of a cylindrical form of the passage opening the passage opening may be a so called through hole.

According to a further embodiment of the invention the opening is a blind opening, which extends from the upper surface of the component carrier into the interior of the component carrier. This may provide the advantage that the lower surface of the component carrier will not be affected by the opening and the full or complete area of the lower surface can be used for mounting or attaching electronic components and/or for forming conductive traces at the lower side of the component carrier.

In this document the term "blind opening" may particularly denote any opening or cavity, which does not go completely through the component carrier from the upper surface to the lower surface. In case of a cylindrical form of the blind opening, the blind opening can be called a blind hole or a blind via.

According to a further embodiment of the invention the antenna structure is formed at least partially at a bottom wall of the blind opening. This may provide the advantage that a large area which delimits the opening within the component carrier from the physical structure of the component carrier can be used for forming the antenna structure. This gives an engineer, who is designing the electronic assembly for the specific application, a high flexibility with regard to possible designs of the antenna structure.

According to a further embodiment of the invention (a) the component carrier comprises at least a first metallic layer and a second metallic layer being separated by at least one dielectric layer and (b) the antenna structure includes at least a part of the first metallic layer and at least a part of the second metallic layer. This may provide the advantage that the antenna structure is not spatially limited to the wall of the opening but can extend also along an x- and/or y-direction both being parallel to the (upper) surface into the interior of the component carrier. Depending on the design and the size of a patterned portion of the respective metallic layer the size of the antenna structure can be adjusted properly.

According to a further embodiment of the invention within the first metallic layer the antenna structure has a first spatial spread and within the second metallic layer the antenna structure has a second spatial spread, which is different from the first spatial spread.

Generally speaking, the described antenna structure has different shapes and/or dimensions within different metallic layers of the component carrier. By appropriately forming the different portions of the antenna structure the sensitivity of the antenna structure for receiving electromagnetic (RFID) radiation may be not spatially uniform and can be adjusted properly depending on the specific application of the described electronic assembly. Accordingly, with respect to the orientation of the component carrier also the spatial intensity distribution of the electromagnetic (RFID) radiation being emitted from the antenna structure can be adjusted by forming the different antenna structure portions in an appropriate manner.

It is mentioned that the antenna structure can also extend over more than two metallic layers. This may allow for realizing the antenna structure with a plurality of antenna portions each being assigned to different metallic layers and each having a different spatial spread.

According to a further embodiment of the invention the first spatially spread and the second spatial spread are measured along one and the same direction within an xy-plane being parallel to the layer structure of the component carrier.

Descriptively speaking, according to the embodiment described here the first portion of the antenna structure within the first metallic layer has a different length than the second portion of the antenna structure within the second metallic layer. This may provide the advantage that the above described adjustment of the spatial sensitivity distribution for receiving electromagnetic radiation respectively of the spatial intensity distribution of emitted electromagnetic radiation can be realized in a simple and easy manner.

According to a further embodiment of the invention the wireless communication component is spatially separated from the opening.

In this respect "spatially separated" may mean that the wireless communication component or a package of the wireless communication component does not form a part of the wall of the opening.

Providing a certain distance between the wireless communication component and the opening may provide the advantage that the wireless communication component can be fully embedded within the component carrier such that it can be protected from external impacts which could affect the functionality and in particular the electric contact between the wireless communication component and the antenna structure. This holds in particular when the described electronic assembly is operated in a rough environment which may be characterized in particular by a large temperature variation.

According to a further embodiment of the invention the opening is at least partially a slit having a first sidewall portion and a second sidewall portion being opposite and parallel to the first sidewall.

Realizing the opening in the form of a slit may provide the advantage that the opening within the component carrier can be formed in an easy manner for instance by a simple milling procedure. Further, the shape and the spatial dimension of the opening can be selected easily depending on the respective application. These benefits can be realized both in connection with a passage opening as well as in connection with a blind opening as specified above.

According to a further embodiment of the invention the opening comprises a widening at one end of the slit, wherein a part of the antenna structure is formed at a sidewall of the widening.

Providing the widening respectively the spatially broadening at at least one end of the slit may provide the advantage that a frequency bandwidth of the described antenna structure can be selected by choosing an appropriate spatial design of the antenna structure. Preferably, the opening comprises not only one but two widenings, wherein respectively one widening is located at one end of the slit.

The widenings may have a shape which is at least partially circular when viewing the component carrier in a direction perpendicular to the layer structure of the component carrier. This may provide the advantage that the widening can be formed in an easy manner by means of a simple drilling procedure.

Realizing the opening with the combination of a (comparatively narrow) slit and a larger widening may further allow for selecting both a capacitive value and an inductive value of the antenna structure in an appropriate manner depending on a required electromagnetic specification for the described electronic assembly. With this design of the opening respectively of the antenna structure the electromagnetic characteristics can be adjusted depending on the respective application.

According to a further embodiment of the invention the opening comprises at least one further slit. Apart from forming the opening in an easy manner for instance by milling this embodiment may provide the advantage that within a comparatively small volume portion of the component carrier a large sidewall area can be provided for realizing the antenna structure.

According to a further embodiment of the invention the opening comprises a further widening at one end of the further slit, wherein a part of the antenna structure is formed at a further sidewall of the further widening. This may allow for an even more flexible design of the antenna structure while taking still benefit of (a) the possibility to realize the opening in an easy manner and (b) the possibility to realize the antenna structure with appropriate values for its capacity and for its interactivity.

According to a further embodiment of the invention the opening has at least partially the shape of a cone.

Also using a cone shape for the opening may provide the advantage that the opening can be realized in an easy and simple manner by applying known techniques for processing a component carrier. Further and even more important may be the matter of fact that the cone shape may loan the antenna structure a wide frequency range such that the number of applications for which the described electronic assembly can be used becomes high.

The described cone may be in particular realized in the same manner as vias are formed in known component carriers.

The sidewall of the cone may be provided completely or alternatively only partially with a metallization forming at least a part of the antenna structure. Depending on the size and on the shape of the cone, in particular the opening angle of the cone, the electromagnetic properties of the antenna structure can be adjusted depending on application specific requirements.

According to a further embodiment of the invention the opening has at least partially the shape of a corrugated horn. The described shape of the corrugated horn having a plurality of preferably circular grooves may also allow to realize a comparatively complex shape of the antenna structure in an easy manner. This holds in particular if respectively one horn is assigned to one dielectric layer of the component carrier being realized as a multilayer printed circuit board.

According to a further aspect of the invention there is provided a method for fabricating an electronic assembly and in particular an electronic assembly as described above. The provided method comprises (a) providing a component carrier, which comprises at least one dielectric layer and a metallic layer, which is attached at the dielectric layer; (b) attaching a wireless communication component to the component carrier; (c) forming an opening within the component carrier, which opening extends from an upper surface of the component carrier into the interior of the component carrier; (d) forming a metallic antenna structure at least partially at a wall of the opening; and (e) electrically connecting the wireless communication component with the antenna structure.

Also the described fabrication method is based on the idea that a metallic antenna structure can be formed at least partially within the 3D dimensions of component carrier. In such a design the antenna structure is automatically protected from external mechanical impacts and, as a consequence, an high robustness of the whole electronic assembly can be achieved.

It has to be noted that embodiments of the invention have been described with reference to different subject matters. In particular, some embodiments have been described with reference to apparatus type claims whereas other embodiments have been described with reference to a method type claim. However, a person skilled in the art will gather from the above and the following description that, unless other notified, in addition to any combination of features belonging to one type of subject matter also any combination between features relating to different subject matters is considered as to be disclosed with this document.

The aspects defined above and further aspects of the present invention are apparent from the examples of embodiment to be described hereinafter and are explained with reference to the examples of embodiment. Embodiments of the invention will be described in more detail hereinafter with reference to examples of embodiment but to which the invention is not limited.

DETAILED DESCRIPTION OF ILLUSTRATED EMBODIMENTS

Figure 1A:
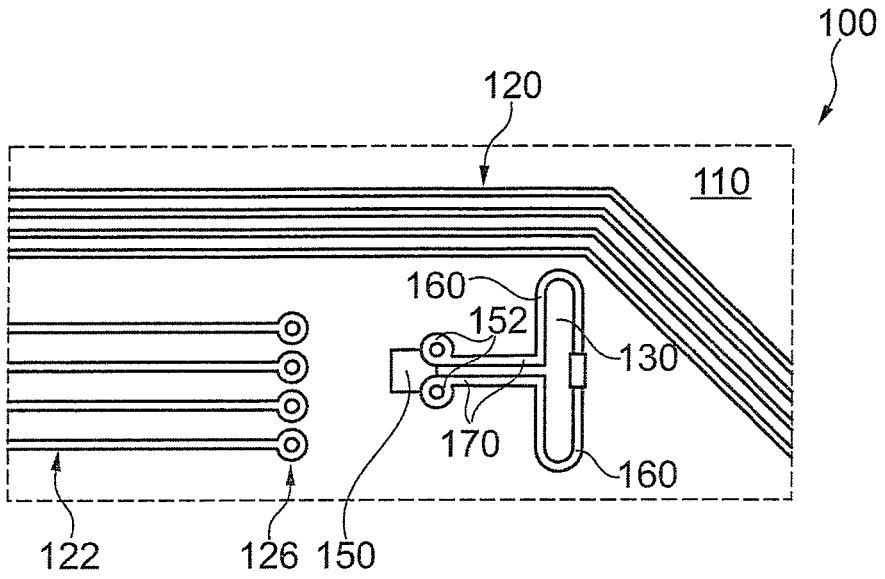
FIGS. 1*a* and 1*b* show in a plan view respectively in a perspective view an electronic assembly having an antenna structure formed at the sidewall of a milled slot.

The illustration in the drawing is presented schematically. It is noted that in different figures, similar or identical elements or features are provided with the same reference signs or with reference signs, which are different from the corresponding reference signs only within the first digit. In order to avoid unnecessary repetitions elements or features which have already been elucidated with respect to a previously described embodiment are not elucidated again at a later position of the description.

Further, spatially relative terms, such as "front" and "back", "above" and "below", "left" and "right", et cetera are used to describe an element's relationship to another element(s) as illustrated in the figures. Thus, the spatially relative terms may apply to orientations in use which differ from the orientation depicted in the figures. Obviously all such spatially relative terms refer to the orientation shown in the figures only for ease of description and are not necessarily limiting as an apparatus according to an embodiment of the invention can assume orientations different than those illustrated in the figures when in use.

Figure 1B:
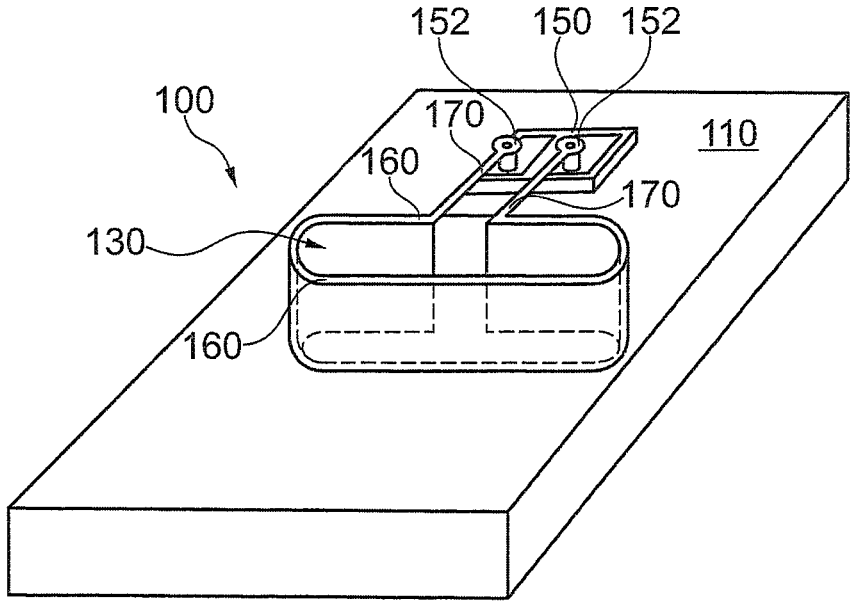

FIGS. 1*a* and 1*b* show in a plan view respectively in a perspective view an electronic assembly 100 according to a first embodiment of the invention. The depicted electronic assembly 100 comprises a component carrier 110 which is also denominated a printed circuit board (PCB). According to the embodiment described here the component carrier 110 is a so called multilayer component carrier 110 which comprises in an alternating sequence non-depicted metallic layers and non-depicted dielectric layers. In the top view shown in FIG. 1*a* several conductor paths respectively conductor traces 120 and 122 can be seen which are formed within an upper structured or patterned metallic layer. Each one of the conductor paths 122 ends at a via connection 126 which in a known manner provides an electric contact to lower (structured) metallic layers.

The electronic assembly 100 comprises a wireless communication component respectively an RFID chip 150 which is embedded within the component carrier 110 (see FIG. 1*b*). The RFID chip 150 comprises two terminals 152 via which the RFID chip 150 is electrically connected to antenna connection conductor paths 170. As can be seen from both FIGS. 1*a* and 1*b*, the antenna connection conductor paths 170 extend to an antenna structure 160. As can be seen exclusively from FIG. 1*b*, the upper surface of the RFID chip 150 is located below the upper surface of the component carrier 110. Since the antenna connection conductor paths 170 are formed on the upper surface of the component carrier 110, each one of the two terminals 152 comprises a via connections extending perpendicular to the surface of the component carrier 110.

The electronic assembly 100 further comprises an opening 130 which according to the embodiment described here extends completely from the upper surface of the component carrier 110 to the lower surface of the component carrier 110. According to the embodiment described here the opening is a milled slot 130 which comprises a sidewall also extending completely through the component carrier 110. At this sidewall of the antenna structure 130 there is applied an appropriate metallization which preferably comprises the metal element copper which may be the same material which is also used for the metallic layers.

It is mentioned that the form or shape of the opening 130 shown in FIGS. 1*a* and 1*b* is only exemplary because also other opening designs can be used which provide a sidewall extending along the thickness direction of the component carrier 110. Further, an antenna structure may also be realized by an appropriate metallization of the sidewall of an opening which does not completely extend through the component carrier 110 and which may also called a "blind opening".

As can be further seen from the Figures showing the electronic assembly 100, the opening 130 is spatially separated from the RFID chip 150. This may in particular provide the advantage that the RFID chip 150 can be fully embedded within the component carrier 110 such that it is protected from negative external impacts.

Figure 2A:
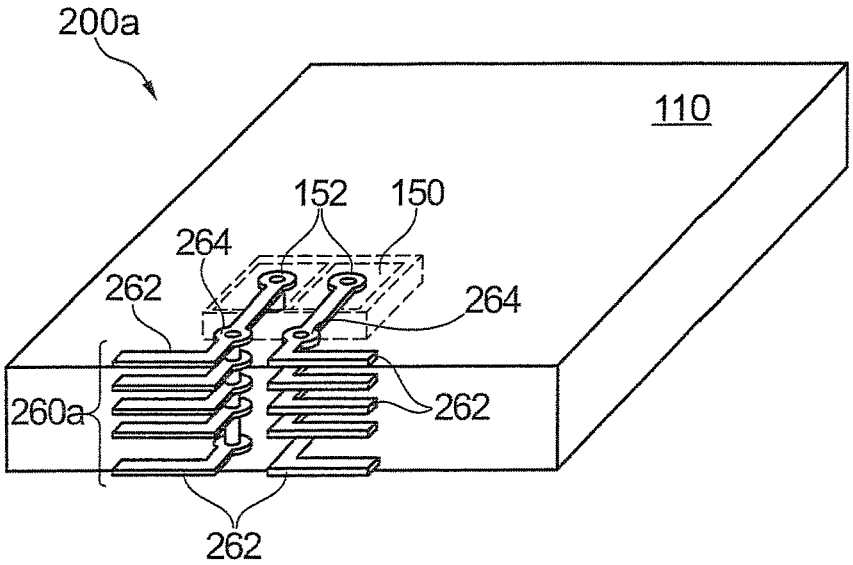
FIGS. 2*a* and 2*b* show in a perspective view electronic assemblies having an antenna structure which extends over at least two patterned metallic layers of a multilayer component carrier.
Figure 2B:
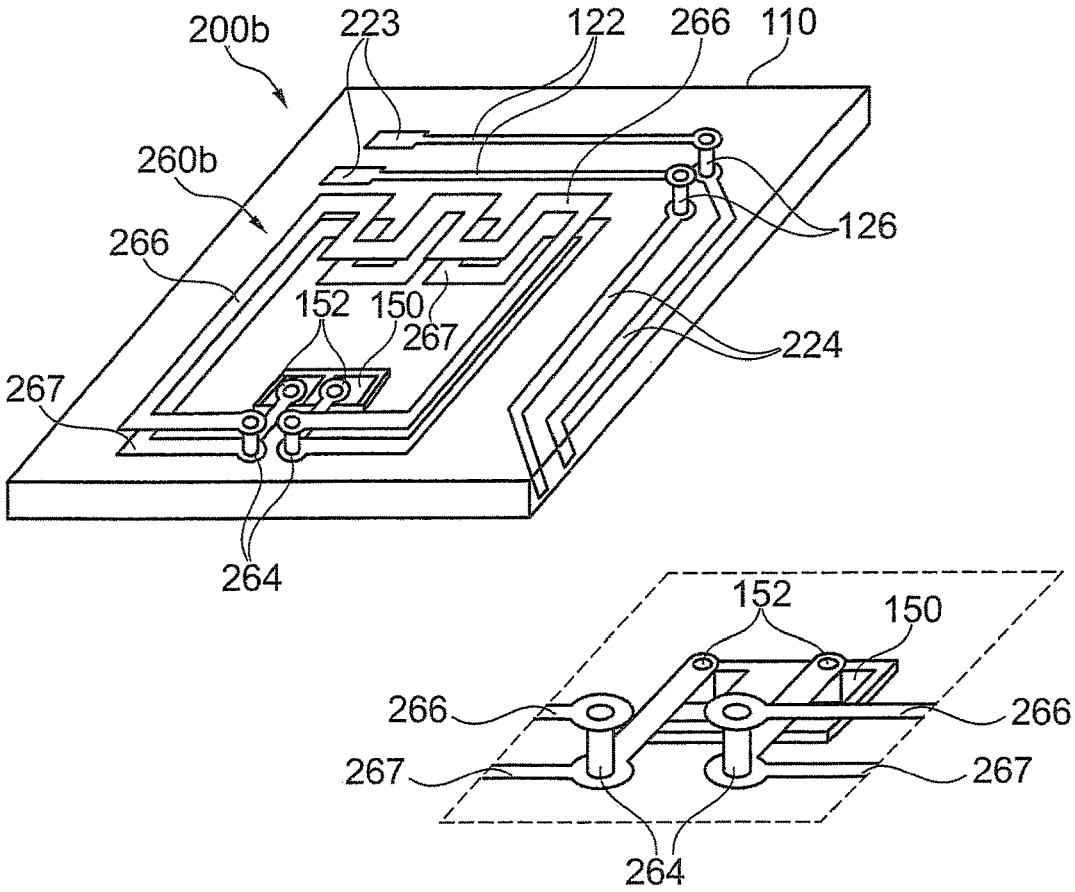

FIGS. 2*a* and 2*b* show in a perspective view electronic assemblies 200*a* and 200*b*, which comprise an embedded RFID chip 150 being connected to an antenna structure 260*a* and 260*b*, respectively. Both antenna structures 260*a*, 260*b* extend over at least two patterned metallic layers of a multilayer component carrier 110.

As can be seen from FIG. 2*b*, the electronic assembly 200*b* comprises on its top surface two connection pads 223 which are connected with respectively one conductor path 224 by means of (a) a conductor path 122 formed on the top surface of the component carrier 110 and (b) a via connection 126.

As can be seen from FIG. 2*a*, the antenna structure 260*a* comprises a plurality of antenna elements 262, wherein respectively two of the plurality of antenna elements are formed within one and the same metallic layer of the multilayer component carrier 110. The antenna elements 262 are arranged within two vertical stacks, wherein the antenna elements 262 of one stack are connected with one of the terminals 152 of the RFID chip 150. The antenna elements 262 within one stack are interconnected with an antenna connection 264 which according to the embodiment described here is realized by means of a metallized opening extending along the thickness of the component carrier 110.

As can be seen from FIG. 2*b*, the antenna structure 260*b* of the electronic assembly 200*b* comprises two antenna substructures, an upper antenna substructure 266 and a lower antenna substructure 267. The two antenna substructures 266 and 267 are formed by two different patterned metallic layers. According to the embodiment described here, each one of the antenna substructures 266 and 267 comprises two L-shaped conductor paths wherein the two ends of the two L-shaped conductor paths are connected via a conductor path portion having a zig-zag pattern made from a plurality of U-shaped conductor path elements. The upper antenna substructure 266 and the lower antenna substructure 267 are connected by means of antenna connections 264, which are also be realized by means of metallized openings extending along the thickness of the component carrier 110.

Figure 3A:
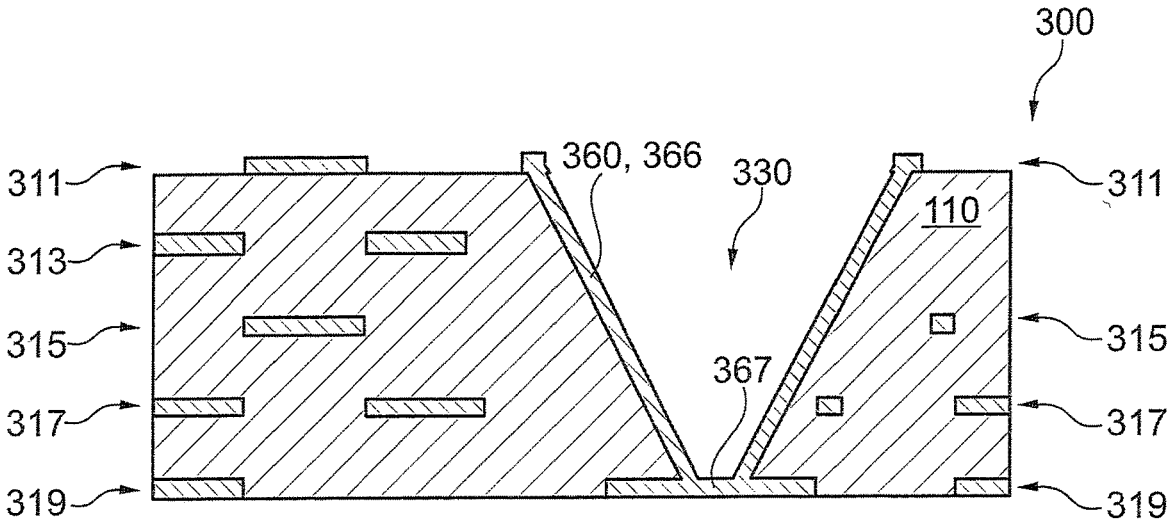
FIGS. 3*a* and 3*b* show in a cross sectional respectively in a plan view a cone shaped antenna structure formed within a multilayer component carrier.
Figure 3B:
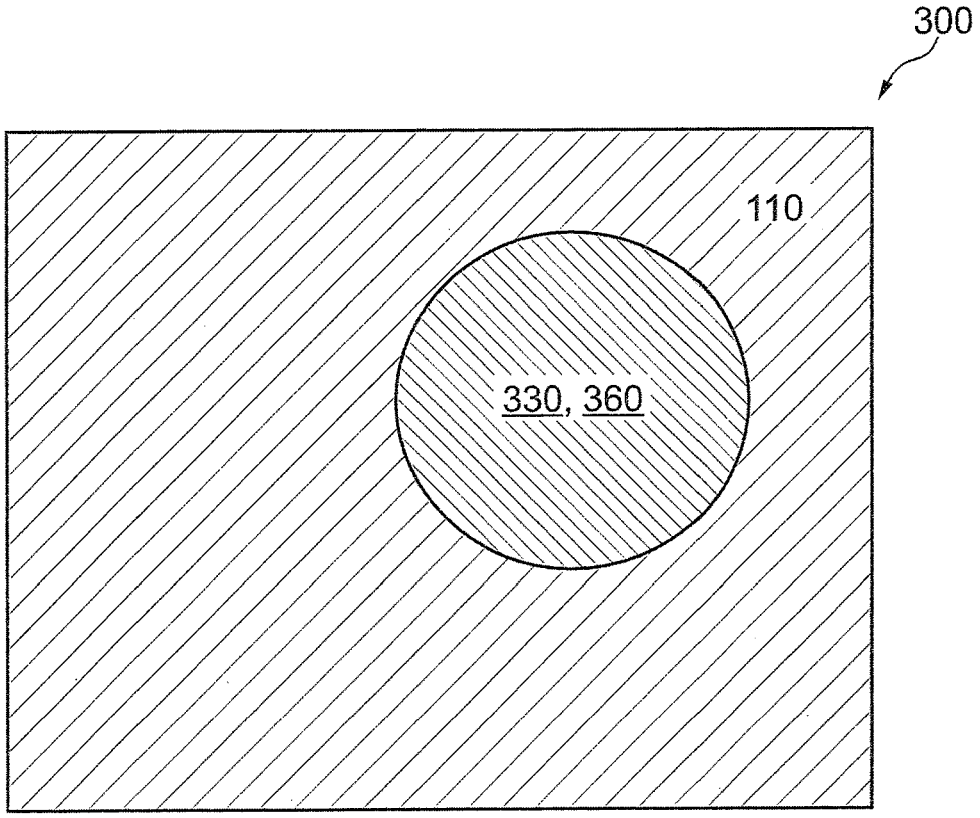

FIGS. 3*a* and 3*b* show in a cross sectional respectively in a plan view a cutaway of an electronic assembly 300, which comprises the cone shaped antenna structure 360 formed within the multilayer component carrier 110.

As can be seen from FIG. 3*a* the component carrier 110 comprises five structured metallic layers 311, 313, 315, 317, and 319 and four non-depicted dielectric layer, wherein respectively one dielectric layer is located (sandwiched) between two structured metallic layers.

Within the component carrier 110 there is provided a cone shaped opening 330, which extends from the top of the component carrier 110 almost completely through the component carrier 110 until the upper side of the bottom metallic layer 319. The cone shaped opening 330 is metallized in such a manner that a metallic sidewall portion 366 and a metallic bottom portion 367 are formed. According to the embodiment described here the antenna structure 360 comprises a side wall portion 366 and a bottom portion 367. The non-depicted RFID chip may be connected in particular via the structured metallic layer 319 with the antenna structure 360.

Descriptively speaking, the antenna structure 360 represents a horn antenna which has the well-known advantage that electromagnetic radiation being emitted is focused along one spatial direction. The same holds of course also for the directional sensitivity for receiving electromagnetic (RFID) radiation. As a consequence, the efficiency for an electromagnetic coupling of the non-depicted RFID chip and a non-depicted RFID reader and/or RFID writer will be high.

Figure 4A:
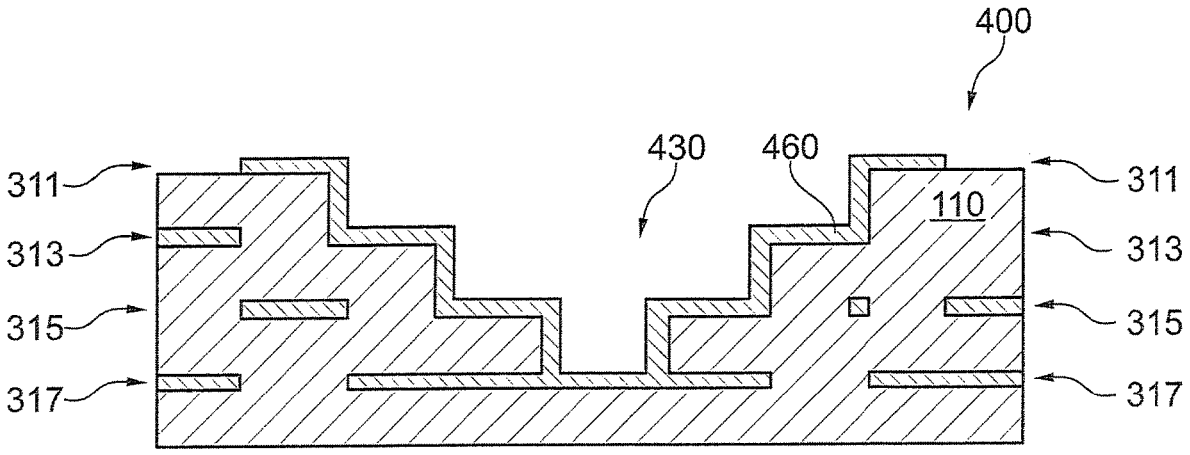
FIGS. 4*a* and 4*b* show in a cross sectional respectively in a perspective view an antenna structure formed as a corrugated horn.
Figure 4B:
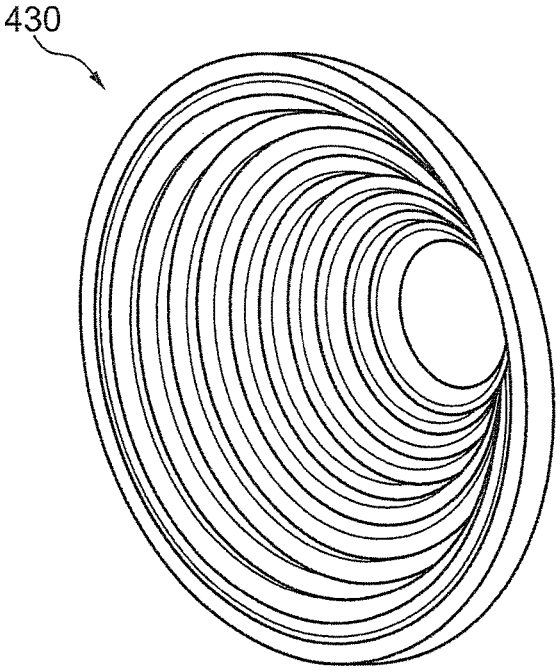

FIGS. 4*a* and 4*b* show in a cross sectional respectively in a perspective view an antenna structure 460 formed as a corrugated horn. By contrast to the cone shaped antenna structure 360 shown in FIG. 3*a*, in the cross sectional view of FIG. 4*a* the metallic antenna structure 460 has a step-shaped structure. Further, as can be seen from FIG. 4*a*, the corrugated horn structure involves only the four structured metallic layers 311, 313, 315, and 317. A non-depicted RFID chip may be connected directly or indirectly with a central portion of the structured metallic layer 317, a part of which forms the bottom of the corrugated horn structure 460.

Realizing the antenna structure 460 as a corrugated horn being formed within the component carrier 110 may also provide the advantage of a directional radiation pattern leading to a directional dependent sensitivity of a RFID data communication between the RFID chip and a non-depicted RFID reader and/or RFID writer.

Figure 5A:
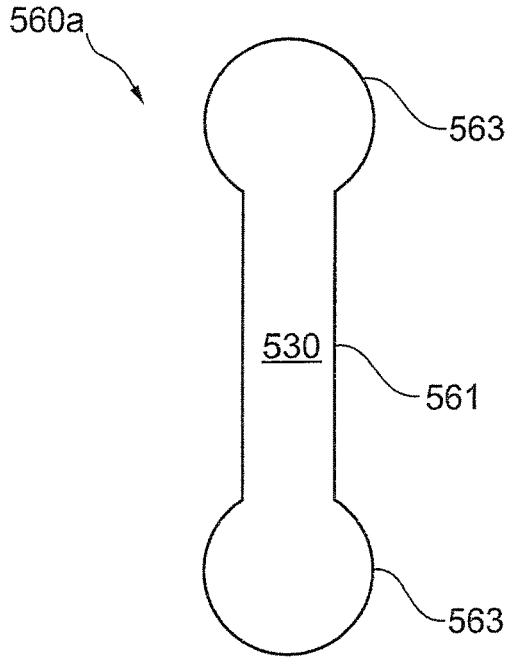
FIGS. 5*a*, 5*b* and 5*c* show in plan views different embodiments of antenna structures comprising at least one slit portion and at least two widened portions.
Figure 5B:
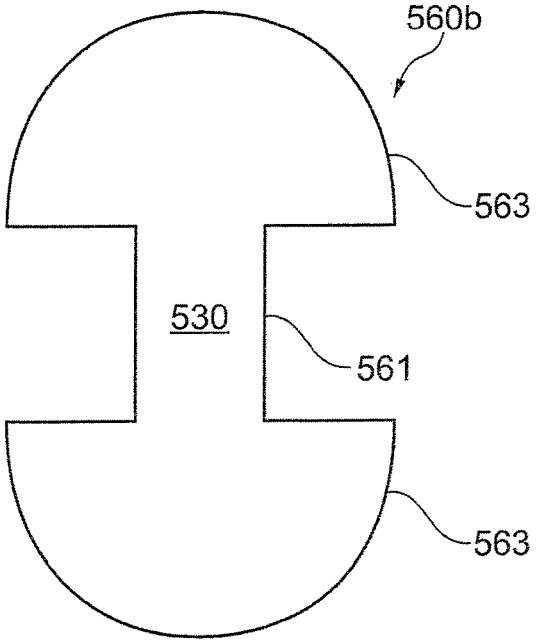
Figure 5C:
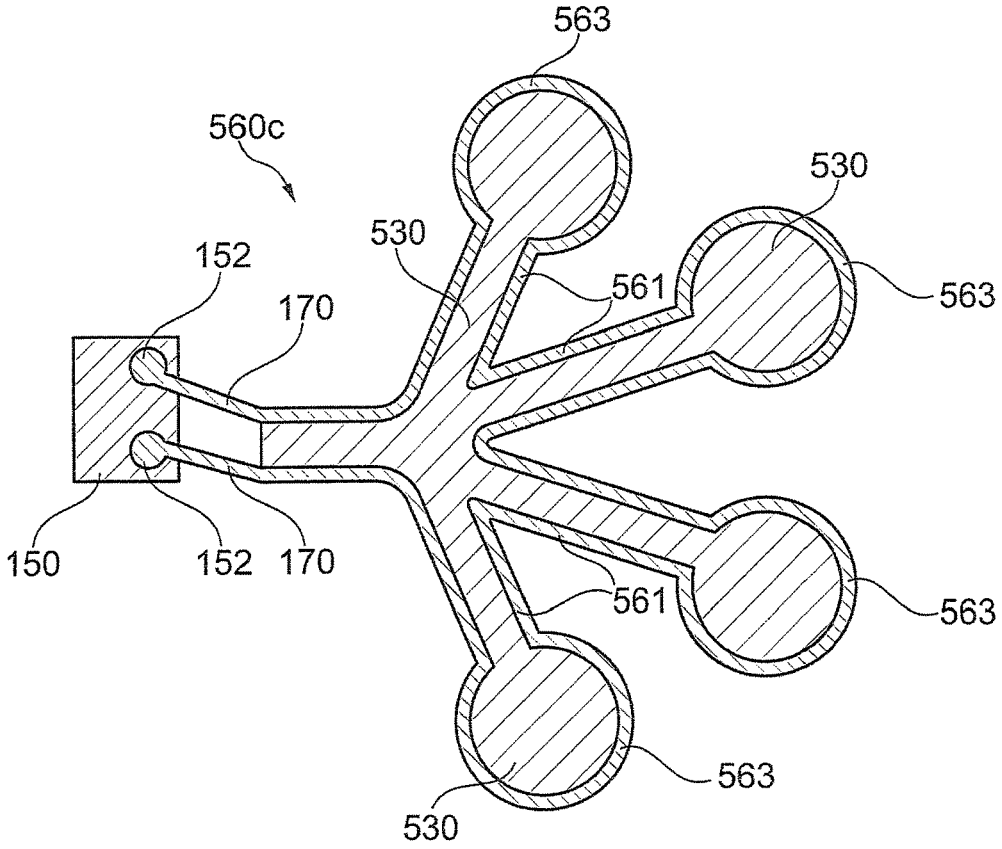

FIGS. 5*a*, 5*b*, and 5*c* show in plan views different embodiments of antenna structures 560*a*, 560*b*, and 560*c*. The antenna structure 560*c* is shown together with an RFID chip 150 being connected with the antenna structure 560*c* by means of two chip terminals 152 and two antenna connection conductor paths 170.

As can be seen from FIG. 5*a*, the antenna structure 560*a* comprises a slit portion 561. The slit portion 561 is formed within a non-depicted component carrier for instance by means of a milling procedure. According to the embodiment described here, the slit portion 561 is a gap extending completely through the non-depicted component carrier along its thickness direction. Alternatively, the slit portion 561 may only be a groove, which does not extend completely through the component carrier. The slit portion 561 defines two opposing sidewall portions which are covered with a metallization layer being a part of the antenna structure 560*a*.

As can be seen from FIG. 5*a*, the opening 530 further comprises two widened portions 563, wherein respectively one widened portion 563 is located at one end of the slit portion 561. According to the embodiment described here, the widened portions 563 have a circular respectively a cylindrical shape. With the widened portions 563 a proper frequency bandwidth of the antenna structure 560*a* can be selected by choosing an appropriate geometric design for the slit portion 561 and/or for the widened portions 563.

Further, as has already been mentioned above, choosing an appropriate geometric design for the slit portion 561 and/or for the widened portions 563 may further allow for selecting both a capacitive value and an inductive value of the antenna structure 560*a* in an appropriate manner depending on an application specific electromagnetic specification. This holds of course also for the antenna structures 560*b* and 560*c* which are described in detail in the following paragraphs.

The antenna portion 560*b* differs from the antenna portion 560*a* only (a) by a different length and width of the slit portion 561 and (b) by the shape of the widened portion 563, which is now an half circle respectively a half cylinder.

As can be seen from FIG. 5*c*, the antenna portion 560*c* comprises an opening 530 having a plurality of slit portions 561 and a plurality of widened portions 563. Respectively one widened portion 563 is located at one end of one slit portion 561. The antenna structure 560*c* is again realized by means of a proper metallization on the entire sidewall having a complex geometric structure and running along the entire opening 530. Again, the narrow slit portions 561 represent the capacitive part of the antenna structure 560*c* and the widened portions 563 represent the inductive part of the antenna structure 560*c*.

Descriptively speaking, the antenna structure 560*c* has the shape of a "frog finger", wherein the "fingers" are connected in series with respect to each other. As a consequence, the entire antenna structure 560*c* radiates preferably into a direction being perpendicular to the plane of drawing.

At this point it is mentioned that the number of "fingers" can deviate from the number "4" as depicted in FIG. 5*c*. In principle any number of figures is possible. Even an embodiment having only one finger may be appropriate for certain applications.

Figure 6A:
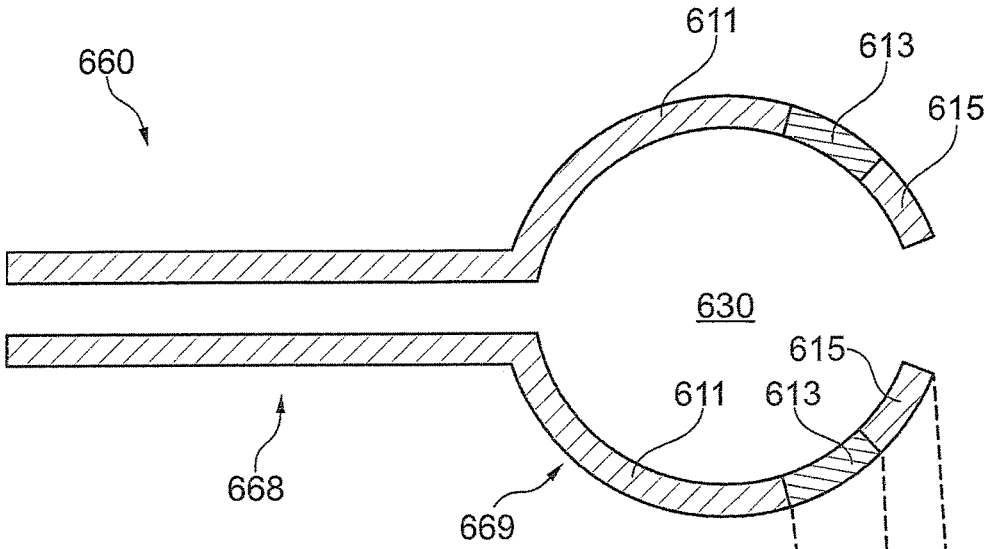
FIGS. 6*a* and 6*b* show in a plan view respectively in a cross sectional view an antenna structure being realized with patterned metallic layers each having a different length.
Figure 6B:
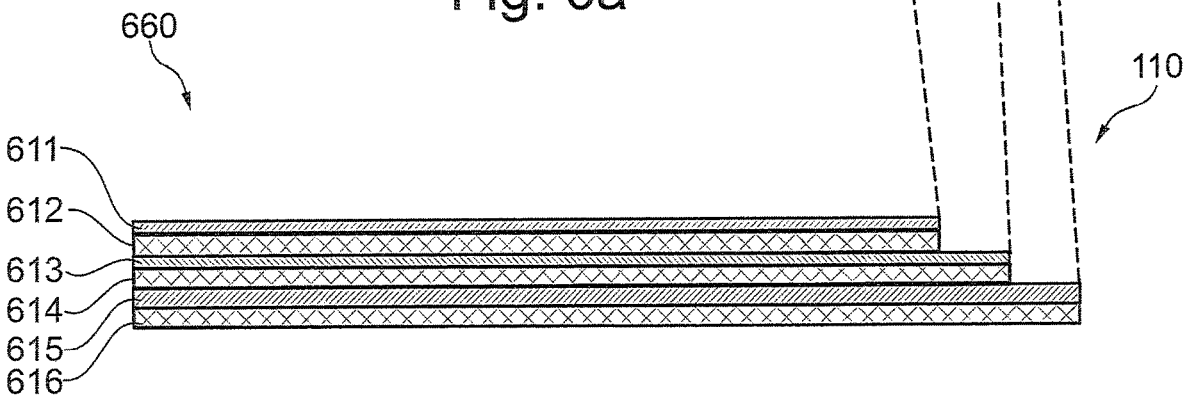

FIGS. 6*a* and 6*b* show in a plan view respectively in a cross sectional view an antenna structure 660 being formed within a component carrier 110 shown in FIG. 6*b*. The component carrier 110 comprises, from the bottom to the top, the following sequence of layers: (a) a dielectric layer 616, (b) a structured metallic layer 615, (c) a dielectric layer 614, (d) a structured metallic layer 613, (e) a dielectric layer 612, and (f) a structured metallic layer 611. Within the component carrier 110 there is formed a circular respectively a cylindrical opening 630. Of course, also other geometries can be used for the opening. The metallic layers 611, 613, and 615 are structured in such a manner that the antenna structure 660, which extends via these three metallic layers 611, 613, and 615, is defined by metallic conductor traces, wherein each trace has a straight trace portion 668 and a curved trace portion 669.

According to the embodiment described here, the straight trace portions 668 of the various metallic layers 611, 613, and 615 have all the same length. By contrast thereto, the curved trace portions 669 of the various metallic layers 611, 613, and 615 have different lengths. This can best be seen from FIG. 6*a*, wherein (a) the two curved portions 669 of the metallic layer 611 encircle only little more than one half of the circular opening 630, (b) the two curved portions 669 of the metallic layer 613 encircle approximately three quarter of the circular opening 630, and (c) the two curved portions 669 of the metallic layer 615 encircle almost the entire circular opening 630. The three dashed lines connecting FIGS. 6*a* and 6*b* represent an "optical guidance" for assigning with each other corresponding edge structures depicted in the two Figures.

As can be seen in particular from FIG. 6*b*, according to the embodiment described here the dielectric layers 612, 614, and 616 have different lengths. Specifically, the length of each one of these layers 612, 614, and 616 corresponds to the length of this metallic layer 611, 613, and 615, respectively, which is located above the respective dielectric layer 612, 614, or 616.

Figure 7:
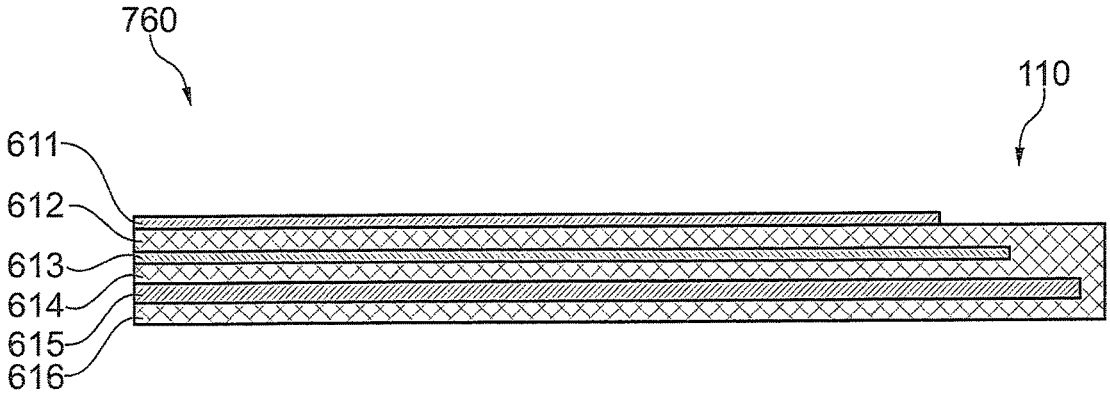
FIG. 7 shows in a cross sectional view an antenna structure with patterned metallic layers each having a different length and all but one being embedded within dielectric layers.

FIG. 7 shows in a cross sectional view a further embodiment of an antenna structure 760, which differs from the antenna structure 660 shown in FIG. 6*b* only in that the two lower metallic layers 613 and 615 are embedded within the dielectric layers 612, 614, and 616.

It should be noted that the term "comprising" does not exclude other elements or steps and the use of articles "a" or "an" does not exclude a plurality. Also elements described in association with different embodiments may be combined. It should also be noted that reference signs in the claims should not be construed as limiting the scope of the claims.

REFERENCE SIGNS

100 electronic assembly
110 component carrier/printed circuit board (PCB)
120 conductor paths
122 conductor paths
126 via connections
130 opening/milled slot
150 wireless communication component/RFID chip
152 terminals
160 antenna structure
170 antenna connection conductor paths
200*a* electronic assembly
200*b* electronic assembly
223 connection pad
224 inner conductor paths
260*a* antenna structure
260*b* antenna structure
262 antenna elements
264 antenna connections
266 upper antenna substructure
267 lower antenna substructure
300 electronic assembly
311 structured metallic layer
313 structured metallic layer
315 structured metallic layer
317 structured metallic layer
319 structured metallic layer
330 opening (cone shaped)
360 antenna structure
366 side wall portion
367 bottom portion
460 antenna structure/corrugated horn structure
430 opening (stepwise)
530 opening
560*a* antenna structure
560*b* antenna structure
560*c* antenna structure
561 slit portion
563 widened portion/widening
611 structured metal layer
612 dielectric layer
613 structured metal layer
614 dielectric layer
615 structured metal layer
616 dielectric layer
630 opening
660 antenna structure
668 straight trace portion
669 curved trace portion
760 antenna structure

The invention claimed is:

1. An electronic assembly, comprising:

a component carrier, which comprises at least one dielectric layer and a metallic layer, which is attached at the dielectric layer;

a wireless communication component, which is attached to or embedded in the component carrier; and an antenna structure, which is formed from a conducting material and which is electrically connected with the wireless communication component;

wherein an opening is formed within the component carrier, which opening extends from an upper main surface of the component carrier into the interior of the component carrier, wherein the antenna structure is formed at least partially at a wall of the opening, wherein the opening is at least partially a slit having a first sidewall portion and a second sidewall portion, wherein the second sidewall portion is opposite and parallel to the first sidewall portion, wherein the slit is a groove, which does not extend completely through the component carrier, wherein the two opposing sidewall portions are connected to each other by opposed curved wall portions being a part of the antenna structure, wherein a direction of main extension of the two opposed sidewall portions and the opposed curved wall portions is oriented perpendicular to the directions of main extension of the component carrier, and wherein the two opposed sidewall portions and the opposed curved wall portions are arranged on the same height level in the component carrier.

2. The electronic assembly of claim 1, wherein an upper edge of the opening being located at the upper surface of the component carrier describes a closed line.

3. The electronic assembly of claim 1, wherein the opening is a passage opening which extends from the upper surface to an opposing lower surface of the component carrier.

4. The electronic assembly of claim 1, wherein the opening is a blind opening, which extends from the upper surface of the component carrier into the interior of the component carrier.

5. The electronic assembly of claim 1, wherein the wireless communication component is spatially separated from the opening.

6. The electronic assembly of claim 1, wherein the opening comprises a widening at one end of the slit, wherein a part of the antenna structure is formed at a sidewall of the widening, and wherein the antenna structure is not a horn antenna.

7. The electronic assembly of claim 1, wherein the opening comprises at least one further slit.

8. The electronic assembly of claim 7, wherein the opening comprises a further widening at one end of the further slit, wherein a part of the antenna structure is formed at a further sidewall of the further widening.

9. The electronic assembly of claim 1, further comprising:

a protective material arranged in the opening.

10. A method for fabricating an electronic assembly, the method comprising:

providing a component carrier, which comprises at least one dielectric layer and a metallic layer, which is attached at the dielectric layer;

attaching a wireless communication component to the component carrier, or embedding the wireless component in the component carrier;

forming an opening within the component carrier, which opening extends from an upper main surface of the component carrier into the interior of the component carrier;

wherein the opening is a slit having a first sidewall portion, a curved sidewall portion and a second sidewall portion, wherein the second sidewall portion is adjacent to the curved sidewall portion and opposite and parallel to the first sidewall portion, and wherein the slit is a groove, which does not extend completely through the component carrier;

forming a metallic antenna structure at a wall of the opening so that the curved sidewall portion and two opposing sidewall portions are a part of the antenna structure; and electrically connecting the wireless communication component with the antenna structure;

wherein a direction of main extension of the two opposed sidewall portions and the opposed curved wall portions is oriented perpendicular to the directions of main extension of the component carrier, and wherein the two opposed sidewall portions and the opposed curved wall portions are arranged on the same height level in the component carrier.

11. The method for fabricating an electronic assembly of claim 10, further comprising:

filling a portion of the opening with a protective material.

12. An electronic assembly, comprising:

a component carrier, which comprises from top to bottom in the following order, a first structured metallic layer, a first dielectric layer, a second structured metallic layer, a second dielectric layer, a third structured metallic layer, and a third dielectric layer, wherein the first structured metallic layer, the first dielectric layer, the second structured metallic layer, the second dielectric layer, the third structured metallic layer, and the third dielectric layer are arranged in parallel with each other, wherein each of the structured metallic layers is defined by a respective metallic conductor trace, wherein each metallic conductor trace has a straight trace portion and a curved trace portion, wherein the straight trace portions of the respective metallic conductor traces have all the same length, and wherein the curved trace portions of the respective metallic conductor trace of the respective metallic layers have all different lengths;

wherein the curved trace portions of the respective metallic conductor trace have an open end;

a wireless communication component, which is attached to or embedded in the component carrier; and an antenna structure, which is formed from the metallic conductor traces of the structured metallic layers and which is electrically connected with the wireless communication component, wherein an opening is formed within the component carrier, which opening extends from an upper surface of the component carrier into the interior of the component carrier, and wherein the antenna structure is formed at least partially at a wall of the opening.

* * * * *